US005611868A

United States Patent [19]

Gurstein et al.

[11] Patent Number: 5,611,868

[45] Date of Patent: Mar. 18, 1997

[54] FABRIC CLEANER WITH OZONE INJECTION

[75] Inventors: Russell Gurstein, Hayden Lake, Id.; Edgar York, Vancouver, Wash.

[73] Assignee: U. S. Products, Inc., Hayden Lake, Id.

[21] Appl. No.: 357,243

[22] Filed: Dec. 13, 1994

[51] Int. Cl.[6] ..... A47L 11/34; B08B 3/00; B08B 5/00; B08B 5/04

[52] U.S. Cl. ..... 134/21; 134/26; 134/37

[58] Field of Search ..... 134/21, 37, 26; 15/320, 321

[56] References Cited

U.S. PATENT DOCUMENTS

| | | | |
|---|---|---|---|
| 2,242,163 | 3/1938 | Bargeboer | 21/127 |
| 2,297,933 | 4/1940 | Yonkers, Jr. | 183/7 |
| 3,848,291 | 11/1974 | Morse | 15/322 |
| 3,964,925 | 6/1976 | Burgoon | 134/21 |
| 4,168,563 | 9/1979 | O'Bryan | 15/321 |
| 4,327,459 | 5/1982 | Gilbert | 15/321 |
| 4,485,519 | 12/1984 | Collier | 15/359 |
| 4,834,948 | 5/1989 | Schmiga et al. | 422/186.19 |
| 4,862,551 | 9/1989 | Martinez et al. | 15/321 |
| 5,180,439 | 1/1993 | Allison | 134/21 |
| 5,185,903 | 2/1993 | Choi | 15/339 |

*Primary Examiner*—Zeinab El-Arini
*Attorney, Agent, or Firm*—Browdy and Neimark

[57] ABSTRACT

A fabric cleaning method uses ozone-bearing cleaning liquid which is spread over the fabric and then vacuumed up. The spreading and the vacuuming are both performed through a cleaning head or tool which has hoses to a vacuum cleaner and cleaning liquid tank. The cleaning liquid is ozonized by injecting air from a conventional ozone generator into the cleaning liquid tank or into the delivery hose. An air pump and/or a venturi in the cleaning liquid line are used for the air injection. The ozone in the air stream dissolves into the cleaning liquid, which both helps to clean the fabric and avoids excessive ozone concentrations in the air. The elements may be housed in a single movable unit.

4 Claims, 2 Drawing Sheets

FABRIC CLEANER WITH OZONE INJECTION

FIELD OF THE INVENTION

The present invention relates to fabric cleaning apparatus for carpets, drapes and the like, particularly cleaning apparatus using vacuum and water or cleaning solutions.

BACKGROUND OF THE INVENTION

Ozone is a gas whose molecules are composed of three bonded oxygen atoms. Ozone is a highly reactive substance, which is used to treat drinking water and swimming pool water, treat industrial waste, and to bleach inorganic products such as clay. Ozone is the second most powerful oxidant after fluorine. It is also a powerful disinfectant.

Ozone may be created by any process which breaks apart diatomic oxygen molecules. The free oxygen atoms thus created react with un-broken diatomic oxygen molecules to create ozone. Of the many methods used to make ozone, only two are of commercial importance: UV radiation and corona discharge.

The radiation of air by ultraviolet (UV) light creates ozone at up to 0.25% by weight concentration in air. A 40-watt ultraviolet light bulb can produce 0.5 gm/hr of ozone. Ultraviolet ozone generation is used for food preservation and in air ducts. Creating ozone with ultraviolet radiation is relatively inefficient. It has been proposed to ozonated water in a reservoir by treating air with UV and then bubbling the air through a tank or other reservoir of water; however, such attempts to ozonate water in this manner have proven unsuccessful.

Greater quantities and higher concentrations of ozone are provided by corona discharge compared with ultraviolet ozone generation. Corona discharge is about 2½ times as efficient as ultraviolet light in terms of energy.

Physically, a corona discharge ozone generator consists of two parallel electrodes (metal plates) held parallel to each other and subjected to a high voltage alternating current. A layer of dielectric usually covers one of the electrodes. The electrodes are typically either a sandwich of flat plates or concentric cylinders. Electrons traveling between electrodes collide with oxygen to create the ozone.

The amount of ozone generated varies exponentially with the voltage and directly with the frequency of the oscillating current. Frequencies up to 2000 hertz are used but many ozone generators work at line frequencies of 50 or 60 hertz. A high-frequency ozone generator will produce seven times as much ozone per electrode area and yield twice the ozone concentration as compared to a low frequency ozone generator. With line frequencies, a simple transformer may be used to increase the working voltage; higher frequencies may require choppers, oscillators, or the like, plus a transformer. The maximum working voltage is about 20,000 volts RMS. Lower voltages with higher frequencies generate more ozone with less chance of burning out the electrodes.

U.S. Pat. No. 4,485,519 to Collier shows an ozone cleaning system, which comprises an ozone producing unit 21 and a cleaning head connected by conduits. A blower forces air through the ozone unit and into the head, where it deodorizes carpets and the like.

The Collier device is not a vacuum cleaner and employs no air pump, except for a blower that directs ozone down to the cleaning head through the pipes 47. The motor M, seen in FIG. 1, drives a cleaning disk 11 (best seen in FIG. 2A) and is not connected to any turbine or suction device.

E. H. Yonkers, Jr., in U.S. Pat. No. 2,297,933, shows a suction cleaner which incorporates a device for electrically charging dust particles which have passed through the filter bag of the cleaner. The charged particles of dust are attracted to an oppositely charged plate. The electrical apparatus acts to ozonize (create ozone in) the air as well as to electrostatically precipitate dust.

U.S. Pat. No. 5,185,903 to Choi also shows a vacuum cleaner with an ozonizer within the exhaust path of the air. Ozone does not contact with the surface being cleaned.

Bargeboer, U.S. Pat. No. 2,242,163, discloses a vacuum cleaner similar to that of Choi and Yonkers, Jr., which incorporates an ozone producer upstream of the filter. Ozone does not contact with the surface being cleaned. Bargeboer also discloses the use of ultraviolet rays to produce ozone.

All the above devices suffer from the drawback of introducing ozone directly into the air, which is typically then dispersed within an enclosed space. Ozone is a strong irritant as well as being a disinfectant and deodorizing agent. As little as one part per million of ozone in air will cause irritation to the eyes and throat. Higher concentrations will affect mental awareness and health.

U.S. Pat. No. 4,834,948, issued to Schmiga et al, discloses an ozone-producing device including an electrode disposed within a quartz tube. The electrode is fed with high frequency alternating voltage to produce ozone in air flowing within the quartz tube. The quartz tube is surrounded by a water jacket in which cooling water flows. The water in the jacket is irradiated by ultraviolet light from the electrode, which passes through the quartz tube and, according to Schmiga et al, sterilizes the water.

FIG. 8 of Schmiga shows its system for purifying the water in a swimming pool 81. Pool water is passed through the cooling jacket in the ozonizer 83. Ozonized air is fed to a "venturi pump" 85, where it is mixed with water (column 6, line 56); a compressor can be used in place of the venturi pump (column 7, line 1), which implies that the "venturi pump" of Schmiga creates a positive pressure rather than a negative pressure, as do devices usually described by the word "venturi". Schmiga does not disclose a compressor for injecting ozonized air into a water stream.

Because of the slight concentration of dissolved oxygen in water, the Schmiga devise does not produce appreciable quantities of ozone in the cooling water within the water jacket surrounding the quartz tube, although Schmiga et al hint that this is so (column 6, lines 60–64).

The prior art does not disclose any device which places ozone in contact with the object being cleaned and which simultaneously cleans the object by means of vacuum and/or vacuum combined with other cleaning methods.

Neither does the prior art disclose any cleaning apparatus for use in enclosed inhabited areas, which does not release large amounts of ozone into the air to irritate persons in the vicinity.

SUMMARY OF THE INVENTION

Accordingly, the present invention has an object, among others, to overcome deficiencies in the prior art such as noted above.

The present invention contemplates a system for employing ozone to clean carpets, drapes, and similar items without releasing large amounts of ozone into the air. The invention includes: a tool acting as a cleaning head (wand) that is moved over the fabric to be cleaned; a vacuum source (such as vacuum cleaner) attached to the cleaning head through a flexible conduit or hose; a tank for containing cleaning liquid (plain water, or other cleaning liquids such as an aqueous solution of detergent, surfactant, etc.); and a fluid connection the tank to the tool head for delivering cleaning liquid to the fabric, from which it may be sucked up by the vacuum hose. The object or fabric being cleaned will generally, but not always, be on a floor or wall.

In addition to the above-listed conventional elements, the present invention also includes means for injecting ozone into the cleaning liquid. These means may include: an ozone generator, which creates ozone in an air stream passing through the generator; a transformer for placing high-voltage alternating current across the ozone generator; and, optionally, an air compressor or blower to force air through the ozone generator.

Air from the generator, containing ozone, is injected into the stream of cleaning liquid either by pressure from the air compressor or by suction. Suction is preferably created in the flowing cleaning liquid by a venturi. While the cleaning liquid is flowing toward the tool head, ozone-containing air bubbles, injected at the venturi, dissolve their ozone into the cleaning liquid. In this way ozone is prevented from escaping into the air in large quantities to irritate people in the area, and is most usefully employed in the cleaning liquid which contacts the fabric to be cleaned.

The ozone generator and injection means can be built as a unit with the other elements of the invention or combined with a pre-existing liquid and vacuum cleaning apparatus, for example, by using a portable ozone generator in conjunction with an already-assembled system, such as a system housed in a truck or built as a complete unit portable in itself.

In one embodiment of the present invention all the elements are combined into one housing which includes the cleaning tool or wand; the entire housing is moved about to clean different areas. In this embodiment the flexible hose is superfluous.

BRIEF DESCRIPTION OF THE DRAWING

The above objects and the nature and advantages of the present invention will become more apparent from the following detailed description of embodiments taken in conjunction with drawings, wherein.

DETAILED DESCRIPTION OF THE PREFERRED EMBODIMENTS

Figure 1:
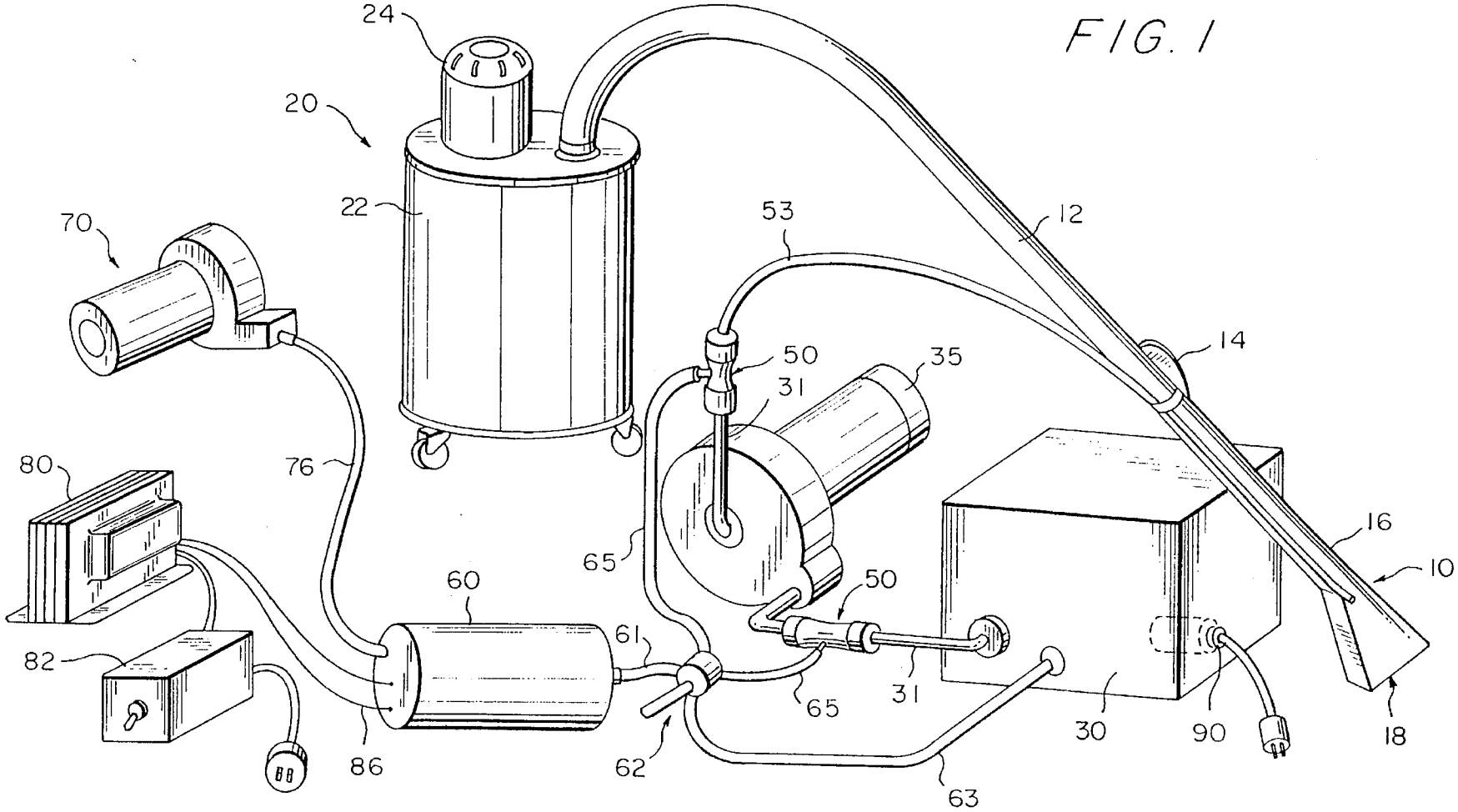
FIG. 1 is a perspective view of an embodiment of the present invention with an independently movable wand.

The present invention, an apparatus for cleaning carpets, drapes, wall coverings, and similar objects, is shown in overview in FIG. 1. Cleaning tool head or wand 10 includes a rigid section 16 and handle 14 for manipulating an elongate nozzle 18 over the surface of the fabric. The nozzle 18 communicates internally by a flexible conduit or hose 12 with a vacuum source 20. The vacuum source 20 may be a conventional vacuum cleaner, including a fan motor 24 and a housing 22. The nozzle 18 also communicates, through cleaning liquid hose 53, with a venturi 50 and pump 35. On the other side of the venturi 50 and pump 35 is a pipe 31 communicating with cleaning liquid tank 30. Tank 30 preferably holds pure water for cleaning the fabric, but may alternatively hold a conventional cleaning liquid, such as a solution of water with detergent or a non-aqueous liquid. A suitable heating means 90, for example a thermostat-controlled electric heater, may also be provided to heat the cleaning liquid in the tank 30. The cleaning liquid pump 35 is disposed either between the venturi 50 and the tool 10 or, alternatively, between the venturi 50 and the tank 30; both positions are shown in FIG. 1, which depicts two of the venturi 50 in various positions. The venturi position between the pump 35 and tool 10 is preferred to avoid cavitation. At the venturi 50 air from ozone delivery lines 61 and 65 is sucked into the cleaning liquid that passes from the pipe 31 into a cleaning liquid delivering hose 53.

Ozonated air for the ozone delivery line 61 is made in an ozone generator 60 which is preferably of the corona discharge type. While the ozone generator 60 may instead be a UV-type ozone generator, such a UV ozone generator is not preferred because, as indicated above, it is not nearly as efficient as a corona discharge type ozone generator.

Air for the ozone generator 60 is supplied through an air line 76 and, optionally, an air compressor 70. Alternating voltage, needed to ozonize air within the ozone generator 60, is supplied from a transformer 80 or other source of alternating voltage. In one embodiment of the present invention, an electrical device 82 may be used to generate high-frequency alternating current, which may then be sent to the transformer 80 for voltage increase or else applied directly to the generator 60 (not shown). Ozone-bearing air leaves the generator through air line 76.

FIG. 1 shows three-way selection valve 62 that can be used to direct the air selectively into one of the venturis 50 via air lines 65 or the tank 30 via an air line 63. If desired, while the machine is resting, the two-way selection valve 62 can direct ozonated air from the generator 60 directly into the tank 30 via the air line 63, whence it may bubble up through the cleaning liquid; however, when the machine is actively being used, the selection valve should be rotated so that the ozonated air from the generator 60 will go directly to the pipe 31 as described above. It will be understood that the two-way selection valve 62 is not essential, i.e. it may be omitted along with the line 63.

The ozone generator 60 is conventional in design, including an inner cylindrical electrode and an outer cylindrical electrode. The air stream flows between the two electrodes where a high voltage field is created by alternating voltage impressed from the transformer 80. The transformer 80 contains a primary winding connected to a line voltage and a secondary winding in which a voltage as high as several thousand volts is induced. This voltage is placed across the two electrodes to ozonize the air within. FIG. 1 depicts a concentric-cylinder type of ozone generator 60. A parallel flat plate arrangement is an alternative, conventional ozone generating configuration.

The transformer 80 may be replaced by an electrical devise of conventional type which creates alternating currents at frequencies higher than line voltage.

It will be understood that, while FIG. 1 depicts two venturis 50, placement of the ozone delivery line 65 and the venturi 50 (or other ozonated air delivery means) either solely downstream or solely upstream of the cleaning liquid pump 35 (i.e. between the cleaning liquid pump 35 and the cleaning head tool 10 or between the tank 30 and the cleaning liquid pump 35) are alternative embodiments, which may be used alone in the present invention, although a single venturi is not illustrated.

The operation of the invention is as follows: the tank 30 is filled with suitable cleaning liquid. The liquid is preferably water, because detergents can neutralize ozone. The vacuum cleaner 20 is activated and transformer 80 is energized with electricity. The air compressor 70 may optionally be activated also. Pump 35 is also activated. It draws cleaning liquid from the tank 30 and forces it through the venturi 50 and onward to the cleaning liquid hose 53 and nozzle 18.

The venturi 50 contains a constricted throat region in which cleaning liquid is forced to flow more quickly, due to the narrower cross-sectional area in the throat. The high velocity of the cleaning liquid creates a partial vacuum which draws ozonized air through the ozone delivery line 65 and injects the air into the stream of cleaning liquid from pipe 31.

The air compressor 70 may optionally be used either alone or in conjunction with the venturi 50 to aid in injecting air into the cleaning liquid stream. Air drawn into the air compressor 70 is forced through the air line 76 to the ozone generator 60.

The present invention, by injecting ozone-bearing air into water, moves the ozone into solution in the water and reduces the concentration in the air. Pure ozone is 12.5 times more soluble in water than oxygen is; the optimum concentration of ozone in air for solubility into water is 2%. The ozone is thus removed from the air, where it can irritate persons who breath it, and put directly in contact with the fabric to be cleaned by the cleaning liquid. The cleaning liquid is then sucked up by the vacuum system before the ozone can dissolve back into the ambient air.

Various embodiments of the present invention may be assembled in different configurations. For example, the invention may be housed together in one enclosure or conveyance (e.g., a truck), except for the hoses and cleaning head tool or wand that may be extended to the surface that is to be cleaned. For another example, the vacuum source and tank may be housed together but the ozone generator may be housed separately, as in the case of a portable or auxiliary ozone generator attached to a main unit or units that include the tank, vacuum source, or other parts of the invention. In the case of the later example, the ozonated air injection means might include: an intermediate coupling fitted between the cleaning head tool and the hoses; a pipe fitting, valve, nozzle, or like device adapted to coupling with the liquid conduit; an air injection needle for penetrating the liquid hose; or any other interconnection means for coupling or injecting air into the fabric cleaning device, whether the injection is accomplished between the tank and the liquid conduit, the conduit and the cleaning head tool, directly into a hose, at a fitting, or any other way. Thus, the present invention may be practiced with standard equipment consisting of cleaning apparatus, ozone generators, and auxiliary fittings or adapters for joining the generator to the cleaning apparatus.

Figure 2:
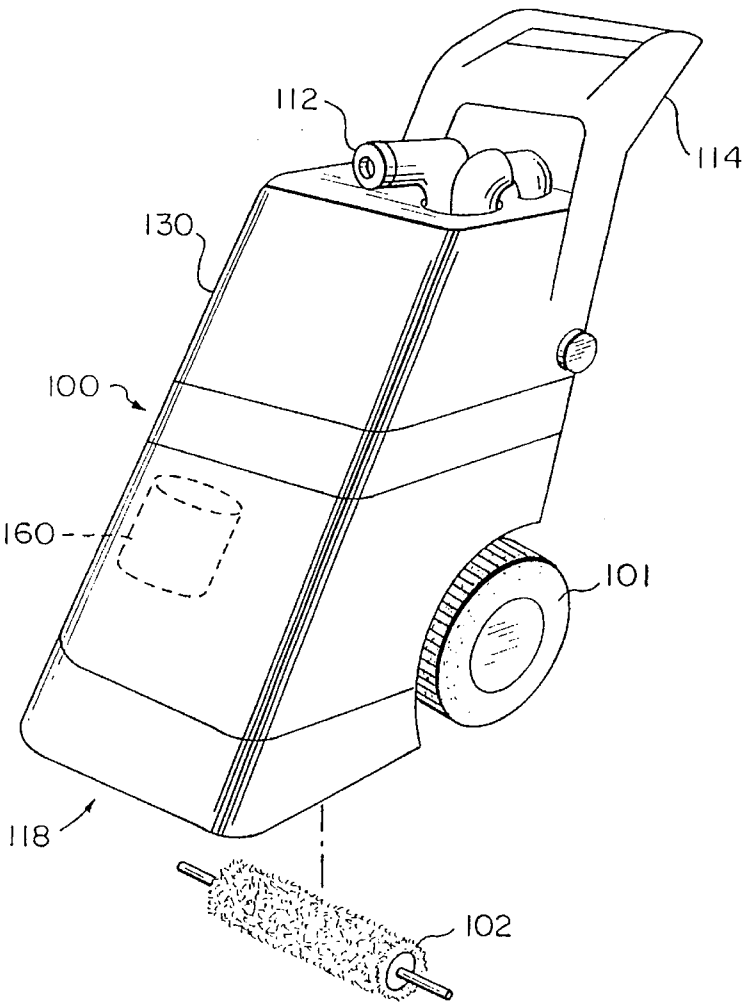
FIG. 2 is a perspective view of the present invention combined into a single housing.

One embodiment of the present invention, shown in FIG. 2, includes all the working parts within a housing 100 that is movable, by means of wheels 101 and a handle 114, such that a nozzle 118 can be moved over a surface. An ozone generator 160 is mounted within the housing 100. The housing 100 may include a tank or tanks 130, and a rotary element 102 (scrubbing brush, polisher,etc.) may optionally be mounted onto the housing 100 either permanently or removably. A hose connection 112 may optionally be provided for an auxiliary flexible vacuum hose (not shown in FIG. 2).

Figure 3:
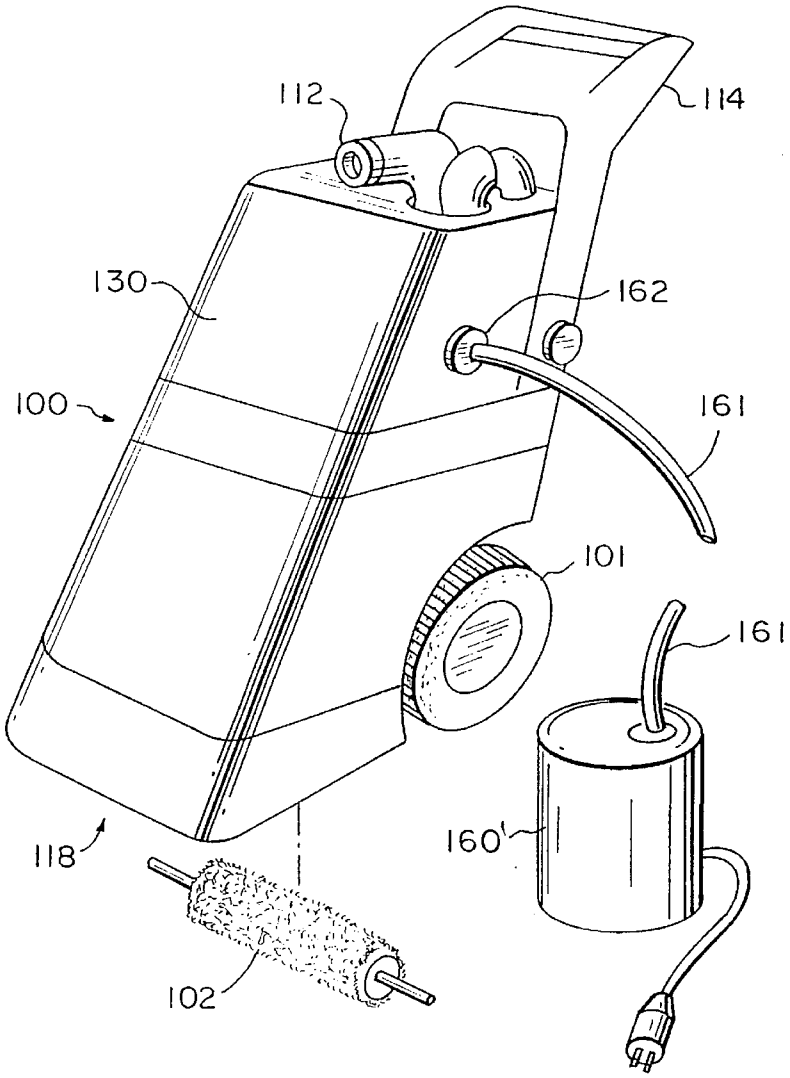
FIG. 3 is a perspective view of the present invention combined into a single housing with means for connecting a portable ozone unit thereto.

A third embodiment of the present invention is depicted in FIG. 3. This embodiment is similar to that of FIG. 2, but includes no internally-housed ozone generator. Instead, an auxiliary portable ozone generator 160' is connected to the housing 100 by means of a coupling 162, which accepts the end of an ozonated air delivery hose 161. In related embodiments (not shown) the generator 160' could be demountably attached to the housing 100, and the ozone connection made either by hose or pipe, or internally, as by a gasket and sealing surfaces on the generator 160' and housing 100.

The foregoing description of the specific embodiments will so fully reveal the general nature of the invention that others can, by applying current knowledge, readily modify and/or adapt for various applications such specific embodiments, without departing from the generic concepts, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A method of cleaning a surface of a carpet, drape, fabric, comprising the steps of:

providing a vacuum means;

providing cleaning liquid;

providing an ozone generator for creating ozone in an air stream;

creating ozone-bearing air in the generator;

injecting the ozone-bearing air into the cleaning liquid to make the cleaning liquid ozone-bearing;

delivering the ozone-bearing cleaning liquid to the surface; and then sucking up the ozone-bearing cleaning liquid from the surface with the vacuum means.

2. The method according the claim 1, wherein the steps of delivering the ozone-bearing cleaning liquid to the surface and sucking up the ozone-bearing cleaning liquid further include the steps of;

providing a source of the cleaning liquid;

providing a cleaning head tool movable over the surface; and providing means for connecting the cleaning head tool to the vacuum means and the source of the cleaning liquid.

3. The method according the claim 2, wherein the step of providing a source of the cleaning liquid further comprises providing a tank; and wherein the step of providing means for connecting the cleaning head tool to the vacuum means and the source of the cleaning liquid further comprises the steps of providing a liquid conduit communicating from the tank to the cleaning head tool and providing a flexible vacuum hose communicating from the vacuum means to the cleaning head tool.

4. The method according the claim 3, wherein the liquid conduit includes a flexible liquid hose.

* * * * *